US005657595A

United States Patent [19]

Fyfe et al.

[11] Patent Number: 5,657,595

[45] Date of Patent: Aug. 19, 1997

[54] FABRIC REINFORCED BEAM AND COLUMN CONNECTIONS

[75] Inventors: Edward R. Fyfe, Del Mar; Frederick P. Isley, Jr., Tracy, both of Calif.

[73] Assignee: Hexcel-Fyfe Co., L.L.C., Del Mar, Calif.

[21] Appl. No.: 496,743

[22] Filed: Jun. 29, 1995

[51] Int. Cl.[6] ..... E04G 23/02

[52] U.S. Cl. ..... 52/252; 52/223.14; 52/296; 52/299; 52/514; 52/516; 52/721.5; 52/723.2; 52/736.4; 52/741.3; 403/265; 404/1; 404/134; 264/36; 156/71

[58] Field of Search ..... 52/252, 259, 294, 52/296, 299, 514, 516, 721.4, 721.5, 723.1, 723.2, 736.3, 736.4, 741.3, 223.4, 223.6, 223.9, 251, 223.14; 403/265; 404/1, 134; 156/71, 172, 188; 264/36

[56] References Cited

U.S. PATENT DOCUMENTS

| | | | |
|---|---|---|---|
| 3,490,983 | 1/1970 | Lee . | |
| 3,700,517 | 10/1972 | Roach . | |
| 3,972,529 | 8/1976 | McNeil . | |
| 4,012,549 | 3/1977 | Slysh . | |
| 4,071,996 | 2/1978 | Muto et al. . | |
| 4,120,998 | 10/1978 | Olez . | |
| 4,310,132 | 1/1982 | Robinson et al. . | |
| 4,671,470 | 6/1987 | Jonas . | |
| 4,786,341 | 11/1988 | Kobatake et al. | 156/71 |
| 4,993,876 | 2/1991 | Snow et al. | 405/216 |
| 5,043,033 | 8/1991 | Fyfe | 156/71 |
| 5,218,810 | 6/1993 | Isley | 52/736.3 X |
| 5,326,410 | 7/1994 | Boyles . | |
| 5,447,593 | 9/1995 | Tanaka et al. | 156/71 X |
| 5,505,030 | 4/1996 | Michalcewiz et al. | 52/249 |

OTHER PUBLICATIONS

Advanced Composites Nov./Dec. 1992 Part I pp. 22–31.

*Primary Examiner*—Robert Canfield
*Attorney, Agent, or Firm*—Oppenheimer Poms Smith

[57] ABSTRACT

A technique for applying high strength fiber fabric to strengthen beams and the connection between beams and either supported platforms or supporting vertical columns is disclosed. Fabric made of high strength fibers such as glass, boron, or carbon, is laid over the connection between a beam and a platform, or between a beam and a supporting column, and impregnated with an epoxy resin or other polymer matrix. The fabric may be additionally fastened to the structural member using adhesives, fabric fasteners, or bolts. The invention is particularly well suited for retrofitting bridges, freeway overpasses, parking structures, and the like to prevent failure during an earthquake.

23 Claims, 6 Drawing Sheets

FABRIC REINFORCED BEAM AND COLUMN CONNECTIONS

BACKGROUND OF THE INVENTION

1. Field of the Invention

The present invention relates to a method for reinforcing structural supports and to reinforced structural supports. More particularly, the present invention relates to the use of high strength fabrics to reinforce beams and connections between beams and other structural members such as platforms, supports for decks, and supporting columns and structures.

2. Background of the Related Art

Construction methods in which elevated platforms are supported by beams which are in turn supported by vertical columns, are used extensively in multilevel parking garages, bridges, freeway overpasses, multilevel commercial and residential construction, and the like. The columns, beams, and platforms are often constructed of steel reinforced concrete.

During an earthquake or other event that produces atypical stresses, these concrete beams are particularly prone to fracture and spalling where they are connected to their supporting vertical columns and where they are connected to the elevated roadway platform. This is because structural members are often exposed to the greatest localized stresses at the point they connect to other structural members. Tests indicate that when these members fail, fractures typically propagate at a 45° angle from perpendicular connections. Once a fracture has begun in a concrete member, it progresses rapidly. In an earthquake, continued shaking can quickly cause the fractured concrete member to spall and crumble, resulting in catastrophic failure. Even where the failure is not catastrophic, fractures in the structural members can compromise the structural integrity such that the entire structure must be demolished and rebuilt at great cost. Also, beams and columns may be weak due to corrosion of reinforcing steel, increased weights on structuresized design, the use of low-strength concrete in the original construction, and other problems.

Although the strength of structural members can be increased by increasing the size of those members, increasing the size of structural members used in elevated roadway construction is both extremely expensive and is inapplicable to retrofit work.

Recent events have demonstrated the vulnerability of many existing structures to earthquakes. In the last 20 or so years, the area around Los Angeles, Calif. has experienced an increase in both the frequency and magnitude of earthquakes. It is expected that this increased seismic activity will continue or even increase still further. Accordingly, critical efforts are underway to identify methods of retrofitting structures to improve their ductility and strength. Methods that do not change the stiffness characteristics of the structure are highly preferred.

The use of high strength fabrics to reinforce vertical columns is known. One method of reinforcing vertical concrete support columns is set forth in U.S. Pat. No. 5,043,033, issued to Fyfe. In this patent, the surface of a concrete column is wrapped with a composite material to form a hard annular shell surrounding the concrete column. The space between the outer composite shell and the concrete column is then pressurized by injecting a hardenable liquid.

Another approach to reinforcing the exterior of an existing concrete support column is set forth in U.S. Pat. No. 5,218,810, issued to Isley, Jr. In this patent, the exterior surface of a concrete column is wrapped with a composite material to form a hard annular shell or sleeve which is in direct contact with the column surface.

Wrapped steel sheets are also used to reinforce vertical columns. In this method a steel sheet is wrapped around the column, with the ends of the steel sheet being welded or otherwise joined to form a continuous steel band encircling the column. One disadvantage to this method is that these steel wraps must be maintained to prevent corrosion. Another disadvantage is that this method increases the stiffness of the member.

None of these methods address the problem of reinforcing horizontal beams where they connect with vertical support columns or roadway platforms. The topology of such connections makes reinforcing these connections and structural members difficult. A need exists therefore for a method to economically reinforce beam-to-column and beam-to-platform connections and increase the ductility of structural members at and around those connections, both in new construction as well as in retrofit applications.

Accordingly, it is an object of this invention to provide reinforced structural connections.

It is a further object of this invention to provide a method of retrofitting existing structures to provide additional strength at beam-to-column and beam-to-platform connections.

It is a further object of this invention to provide a structure with reinforced beam-to-column and beam-to-platform connections for new construction.

It is a further object of this invention to reinforce structural beams along an axis that is approximately 45° from the angle of intersection with a supporting column.

It is a further object of this invention to provide a means by which damaged structures may be repaired, thereby strengthening them and obviating the need to demolish and reconstruct them.

These and other objects and features of the present invention will become better understood by reference to the following detailed description when taken in conjunction with the accompanying drawings.

SUMMARY OF THE INVENTION

A high strength composite material such as fiber glass fabric impregnated with a polymer matrix such as epoxy resin is affixed to a structural member at the point where the member intersects with another member, such that the same piece of composite material covers both members near the connection as well as covering the connection itself. Typically, the composite material is comprised of multiple layers, with at least one layer having fibers oriented longitudinally 90° from the direction in which fractures would otherwise typically propagate.

The composite material may be either formed at the work site by laying resin-impregnated fabric over the beam connection to be strengthened, or may be a shell that has been pre-formed and is applied to the structure in the field.

If the composite material is pre-formed, it is then attached to the structure using adhesives, anchor bolts, or through bolts to hold it tightly to the structure. If the composite material is formed at the work site by laying fabric impregnated with resin over the structure, the resin serves additionally to adhere the composite material to the structure, and the use of additional fasteners is optional.

The fabric spreads stresses out over the surface of the structural member to which it is attached, increasing the ductility of the member. Reinforced in this way, the member can now withstand much greater stresses before fracturing and spatling than could the unreinforced member.

In a first preferred embodiment, a composite reinforcement layer is formed by laying cloth sections onto a beam and a platform supported on the beam. Preferably, resin is impregnated within the fabric before the fabric is applied to the structural member. Alternatively, the fabric may be laid on the structural member, and impregnated with resin thereafter.

Alternatively, the composite reinforcement layer may be a pre-formed shell in the shape of a ranged channel that is applied to the underside of a beam and a platform supported by the beam, so as to encase the enclosed sides and bottom of the beam, and to cover at least a portion of the underside of the platform. The shell is affixed securely to the beam and platform using adhesives, fabric fasteners, anchor bolts, or through bolts. Once the shell sections have been secured in place, the various sections can be connected together by laminating additional layers of fabric and resin over the spans between shell sections.

In a second preferred embodiment, where beams and supporting columns meet in a "T" connection, these connections are reinforced by laying "T" shaped sections of cloth over the connection. The cloth is woven of 90° mesh and is cut on a 45° bias, so that the fibers are aligned at ±45° from the axis of the supporting column. The fibers therefore provide maximum reinforcement for the beam perpendicular to the same ±45° angles at which the beam would most likely fracture in the absence of reinforcement. Unidirectional fabric is then laid or wrapped over the bias cloth. Alternatively, both layers of fabric may be unidirectional, with the fibers of the two layers oriented perpendicular to each other. Again, the fabric may be impregnated with resin either before or after it is applied to the structural member.

In a third preferred embodiment, cloth made from primarily unidirectional fibers is wrapped on ±45° diagonals over the top and under the arms of a "T" connection.

In a fourth preferred embodiment, the basic invention is modified somewhat to strengthen and repair an already damaged structure. The damaged structure is examined to determine fracture direction(s), and the fabric is selected, cut, and applied to provide maximum strength at an angle of 90° relative to the fracture(s).

DETAILED DESCRIPTION OF THE INVENTION

Figure 1:
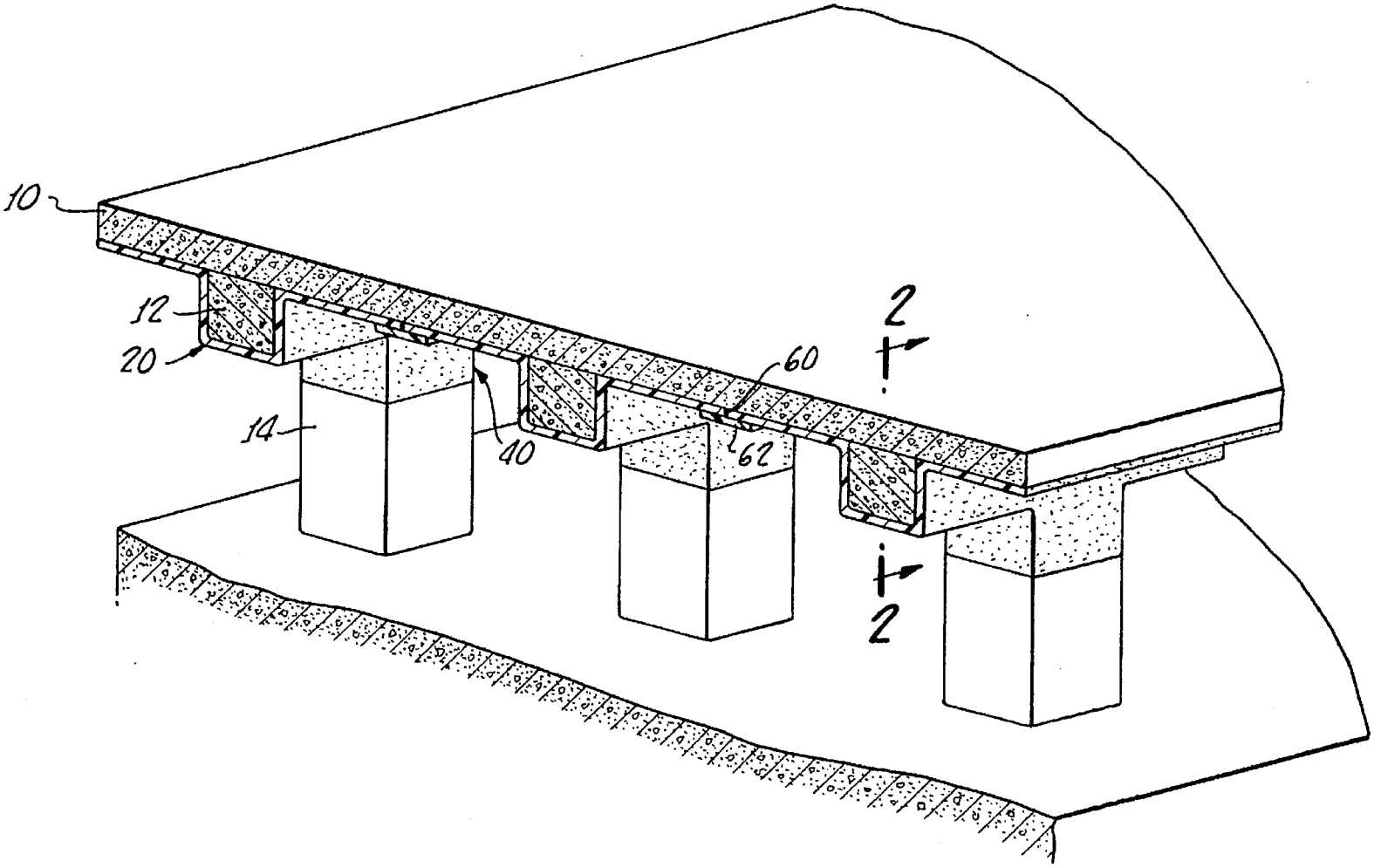
FIG. 1 is a sectional perspective drawing of an elevated roadway reinforced according to a first and second preferred embodiment of the present invention.

FIG. 1 shows a sectional view of an elevated roadway whose beam-to-platform and beam-to-column connections have been reinforced according to the present invention. A roadway platform 10 is supported by horizontal beams 12, which are in turn supported by vertical support columns 14. A first high strength composite reinforcement layer 20 reinforces the connection between beam 12 and platform 10. First composite reinforcement layer 20 is applied underneath and around the sides of beam 12, and underneath platform 10. The composite reinforcement layer 20 is preferably formed by applying fabric impregnated with resin to the structural member. Alternatively, composite reinforcement layer 20 may be pre-formed in sections. If pre-formed sections are used, seams 60 are spliced together using lap splice pieces 62 comprised of sections of fabric impregnated with resin. For the lap splice pieces 62, as well as other areas where layer of fabric overlap, the layers should overlap at least 30 centimeters for corrosion protection and to provide maximum transverse strength.

Additionally, a second high strength composite reinforcement layer 40 reinforces the connection between beam 12 and column 14. Second composite reinforcement layer 40 is shown in greater detail in FIG. 5.

Figure 2:
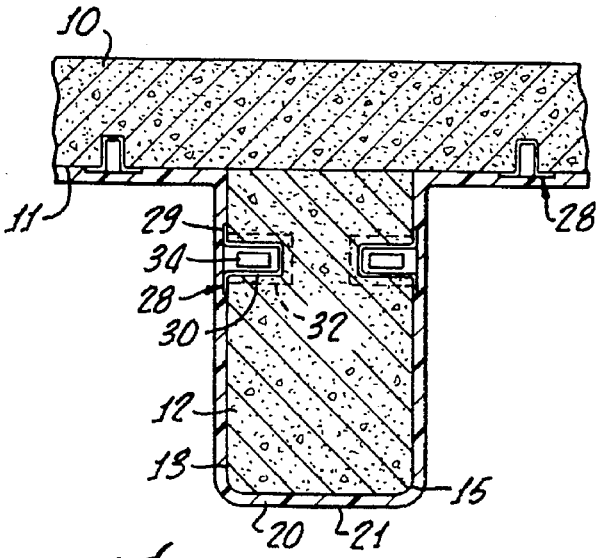
FIG. 2 is a sectional view taken along section 2—2 of FIG. 1, illustrating the use of fiber fasteners with a first preferred embodiment of the present invention.

FIG. 2, taken along section 2—2 in FIG. 1, shows a section of one beam 12 and part of platform 10. Before the reinforcement layer 20 is applied, all corners 15 are preferably rounded to a minimum radius of 4 centimeters. Fiber fasteners 28 help to secure composite reinforcement layer 20 to the surface 13 of beam 12 and the surface 11 of platform 10. Fabric fasteners 28 are preferably configured as sleeves or strips to be inserted into predrilled cavities 32. Fabric fasteners 28 include engagement portions 29 and anchored portions 30 that extend into cavities 32. After cavities 32 are formed, fabric fasteners 28 are partially inserted into cavities 32 so as to seat anchored portions 30 within cavities 32 against structural member 12. The anchored portions 30 are preferably impregnated with an adhesive resin or other adhesive product. Once the resin-impregnated anchored portions 30 are positioned within cavities 32, a plug 34 is used to wedge the anchored portion 30 of each fabric fastener 28 into engagement with structural member 12. Plug 34 is preferably formed from an elastomeric substance, e.g., rubber, that is compatible with the resin or other material with which anchored portions 30 are impregnated.

While the use of an in situ plug in the anchoring system shown in FIG. 2 is generally preferred, the anchoring of anchored portions 30 may be accomplished without the use of an in situ plug by impregnating the anchored portions 30 with a resin which will adhere to the structural member 10 upon curing. Alternatively, a pre-formed hot melt plug can be used instead of a rubber plug 34 to seat anchored portions 30 in cavities 32, in which case the hot melt adhesive is melted in place by injecting hot air into cavities 32 or using other suitable means.

After anchored portions 30 are seated within cavities 32, the fibers which extend outward from face 13 of structural member 12 are partially or totally separated and then wet out with the preferred resin (if not wetted out already) to form engagement portions 29 and fanned out against face 13.

In an alternative preferred method (not shown) for anchoring composite reinforcement layer 20 to structural member 12, the fabric layers of composite reinforcement layer 20 are provided with apertures corresponding to anchor receiving cavities 32. Upon placing the fabric layers in the desired positions against face 13, engagement portions 28 are drawn through the apertures and fanned out against the exposed outer surface 21 of composite reinforcement layer 20.

Figure 3:
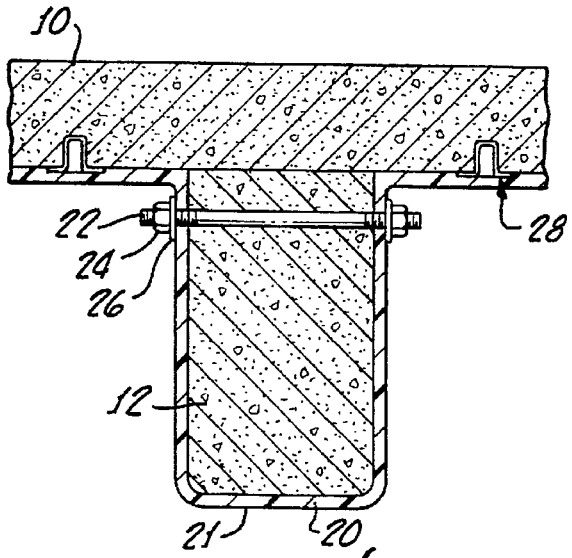
FIG. 3 is a sectional view taken along section 2—2 of FIG. 1, illustrating the use of bolts with a first preferred embodiment of the present invention.

FIG. 3 shows an alternative method of securing the composite reinforcement layer 20 to the structural member 12. Bolts 22 (only one of which is shown) extend through beam 12. If desired, the bolts 22 may be prestressed. Nuts 24 are tightened down over washers 26 to a torque sufficient to provide securing of the reinforcement layer 20 to the structural number 12. Fabric fasteners of the type illustrated in FIG. 2 secure the composite reinforcement layer 20 to platform 10. Other methods for securing composite layer 20 to structural members 12 and 10 will be readily apparent to those skilled in the art. For example, threaded studs that extend through an aperture in composite reinforcement layer 20 may be grouted into holes predrilled into the structural members, and nuts and washers tightened over the studs to secure the composite reinforcement layer in place. Alternatively, the threaded studs may be secured using conventional lead anchors. Similarly, bolts may be threaded into lead anchors inserted into predrilled holes in the structural members.

Figure 4:
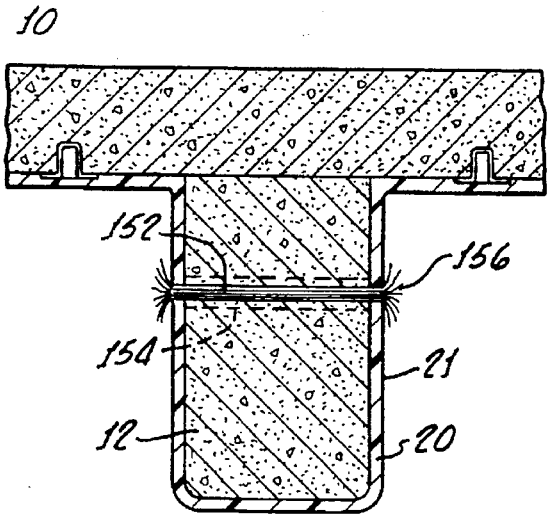
FIG. 4 is a sectional view showing a reinforced column and beam, illustrating the use of fiber roving to anchor the composite reinforcement layer to the structure.

FIG. 4 illustrates yet another method of anchoring a composite reinforcement to the structure, using a roving rod made from fiberglass or other high strength fiber material. A hole 154 is drilled through structural member 12. A fabric roving rod 152 containing many tiny fibers is then inserted through hole 154 and a corresponding hole in fiber reinforcement layer 20, and the individual fibers 156 of roving 154 are then splayed out against outer surface 21 of fiber reinforcement layer 20. Individual fibers 156 are then adhered to outer surface 21 using a polymerizable resin or other adhesive compatible with composite reinforcement layer 20. Where multiple composite reinforcement layers are used, the individual roving fibers are preferably sandwiched between reinforcement layers. It is to be understood that any of the anchoring means discussed above may be used to secure the composite reinforcement layer to the structural member in any of the configurations and embodiments of the present invention discussed herein below.

Preferably, the outer surface 13 of beam 12 (or other structural member) is prepared for reinforcing by first cleaning it thoroughly to remove dirt and other loose matter from its surface. It is often desirable though not necessary to coat the portion of the structural member to be reinforced with a preferred resin before application of the resin-impregnated fabric layers to the surface. If the surface is porous, it may be desirable to allow the resin to penetrate the surface before applying the resin-impregnated fabric layers to the structural member.

The fabric used in composite reinforcing layer 20 may be either a single layer of cloth, or may be multiple layers. Where a single layer of cloth is used, it will often be desirable to use weft cloth containing both horizontal and vertical fibers. Where multiple layers of fabric are used, it will often be desirable to alternate the orientation of the fibers to provide maximum strength along multiple axes.

Figure 5:
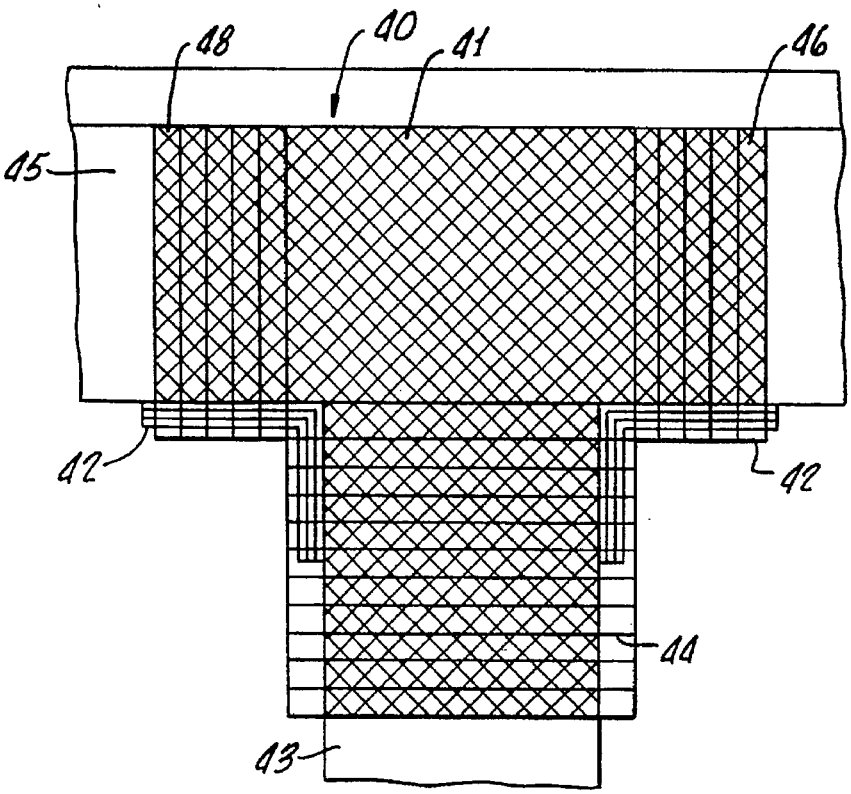
FIG. 5 is a side elevation view of a beam and vertical support column reinforced according to a second preferred embodiment of the present invention.

FIG. 5 illustrates a second preferred embodiment of the present invention. A first "T" shaped piece of fabric 41 is applied over the "T" formed by the intersection of beam 12 with support column 43. The cloth is cut on the bias so that the fibers are aligned ±45° relative to column 43, so as to provide maximum strength perpendicular to the most likely fracture axis. The "T" shaped piece of fabric may include a portion (not shown) that wraps underneath beam 45 to cover at least a portion of the underside of beam 45. A second "T" shaped piece of cloth, which may similarly include an underwrapping portion, is applied to the obverse side of the beam (not shown). Optionally, "L" shaped cloth pieces 42 are applied to the sides of column 43 and on the undersides of beam 45. Column tie wrapping 44 containing primarily unidirectional fibers is then wrapped around column 43 to bind the "T" and "L" shaped pieces 41 and 42 tightly to column 43. If the top surface of beam 45 is not in full contact with a deck above it, then additional tie wraps 46 and 48 comprising unidirectional fabric pieces are wrapped around beam 45 to bind the "T" and "L" shaped pieces 40 and 42 tightly to beam 45. If the top of beam 45 is in full contact with a deck, then tie wraps 46 and 48 will be wrapped around only three sides of beam 45. As in the first embodiment illustrated in FIG. 2, the composite reinforcing layer may be additionally secured by fabric fasteners, bolts, or the like.

It is to be understood that the present invention is equally applicable to reinforce a beam and column combination whether the beam and column are formed separately and then connected together, or whether they are cast integral so as to define a seamless unit. Similarly, the present invention is equally applicable when the beam and platform are cast integral.

Figure 6:
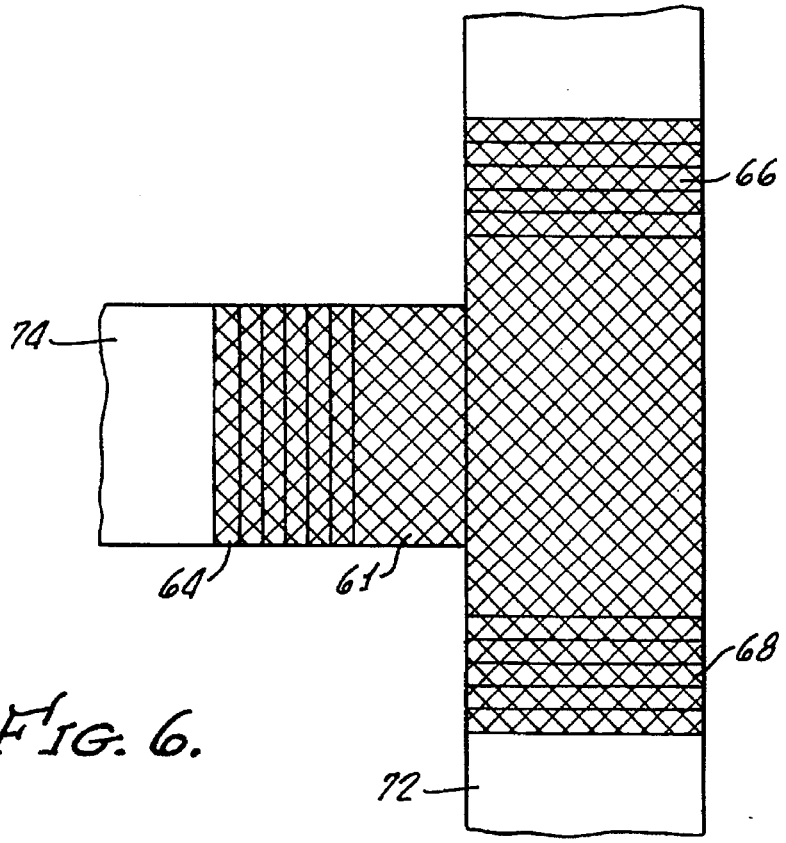
FIG. 6 is a side elevation view of a vertical support column and associated horizontal member reinforced according to a second preferred embodiment of the present invention.

FIG. 6 shows a horizontally oriented "T" structural connection reinforced according to a second preferred embodiment of the present invention. Vertical column 72 is connected to a cross member 74. Cross member 74 may be either a beam supporting a load such as a midway platform, or may be a cross support between vertical columns 72. When cross member 74 is a cross support, it may be connected to column 72 at some angle other than 90° . Bias-cut fabric section 61 wraps around at least two sides of cross member 74, and at least three sides of vertical column 72. Where possible, tie wraps 64, and 66 and 68, wrap completely around cross member 74 and vertical column 72, respectively.

Figure 7:
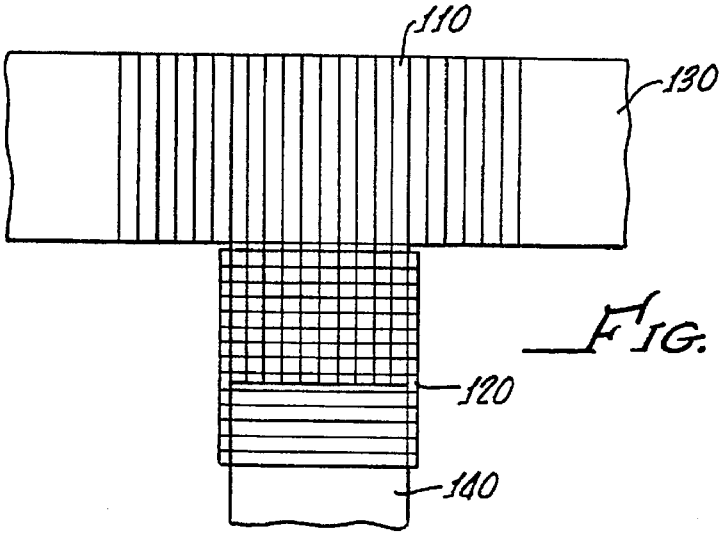
FIGS. 7 and 8 are side elevation views of alternative second preferred embodiments, in which the reinforcement includes unidirectional fibers.

FIG. 7 shows an alternative reinforcement for a "T" structural connection, where "T" shaped fabric piece 110 has fibers oriented perpendicular to the axis of beam 130, and tie wrapping 120 has fibers oriented perpendicular to the axis of column 140.

Figure 8:
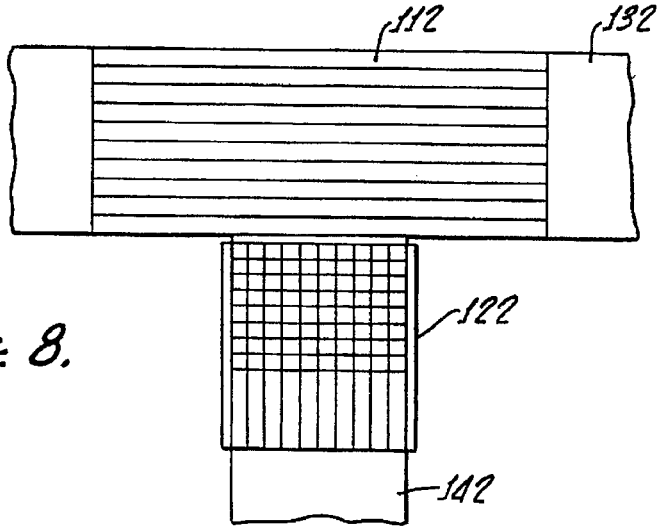

FIG. 8 shows yet another alternative reinforcement for a "T" structural connection, where "T" shaped fabric piece 112 has fibers oriented along the axis of beam 132, and tie wrapping 122 has fibers oriented perpendicular to the axis of column 142. One advantage to orienting the fibers of fabric piece 112 along the axis Of beam 132 is that this gives the beam maximum flexural strength.

Figure 9:
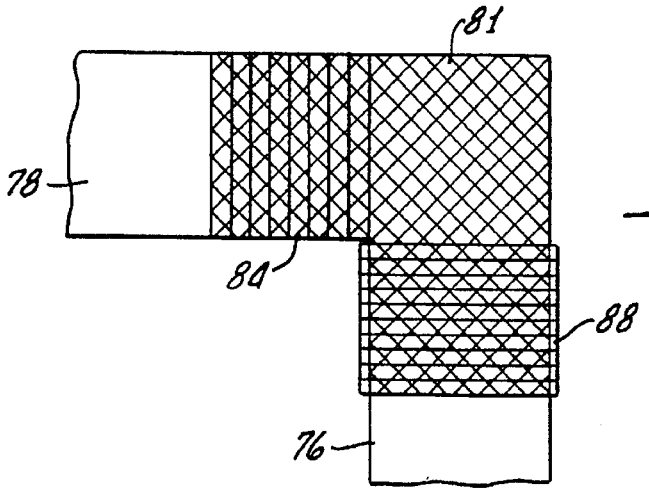
FIG. 9 is a side elevation view of a second preferred embodiment of the present invention as applied to an "L" shaped support structure.

FIG. 9 shows an "L" shaped connection between a horizontal beam 78 and a vertical support column 76 reinforced according to the present invention. Bias-cut fabric section 81 wraps around three sides of the cross member to column connection. Tie wraps 84 and 88 further anchor bias-cut fabric section 81.

Figure 10:
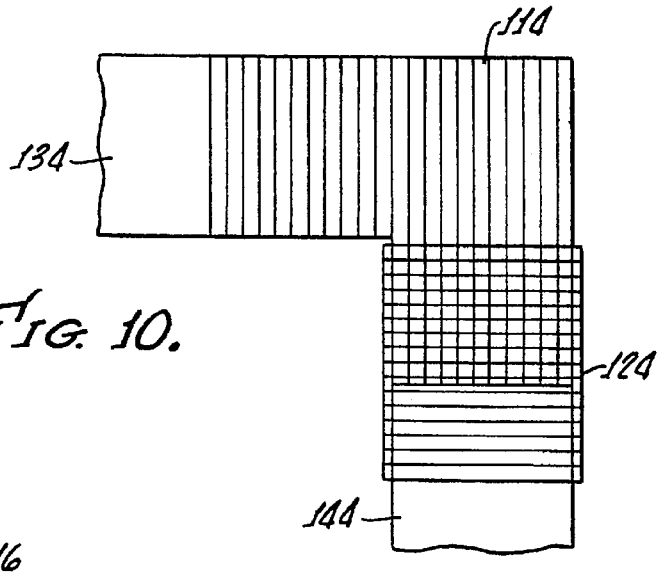
FIGS. 10 and 11 are side elevation views of alternative second preferred embodiment as applied to an "L" shaped support structure, in which the reinforcement includes unidirectional fibers.
Figure 11:
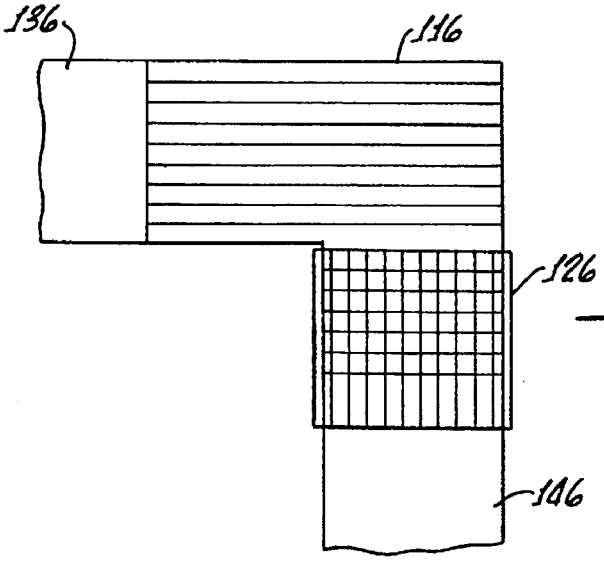

FIGS. 10 and 11 show "L" shaped connections reinforced with unidirectional fibers. The orientation of fibers perpendicular to the axis of the beam as shown in FIG. 11 result in maximum flexural strength of the beam.

Figure 12:
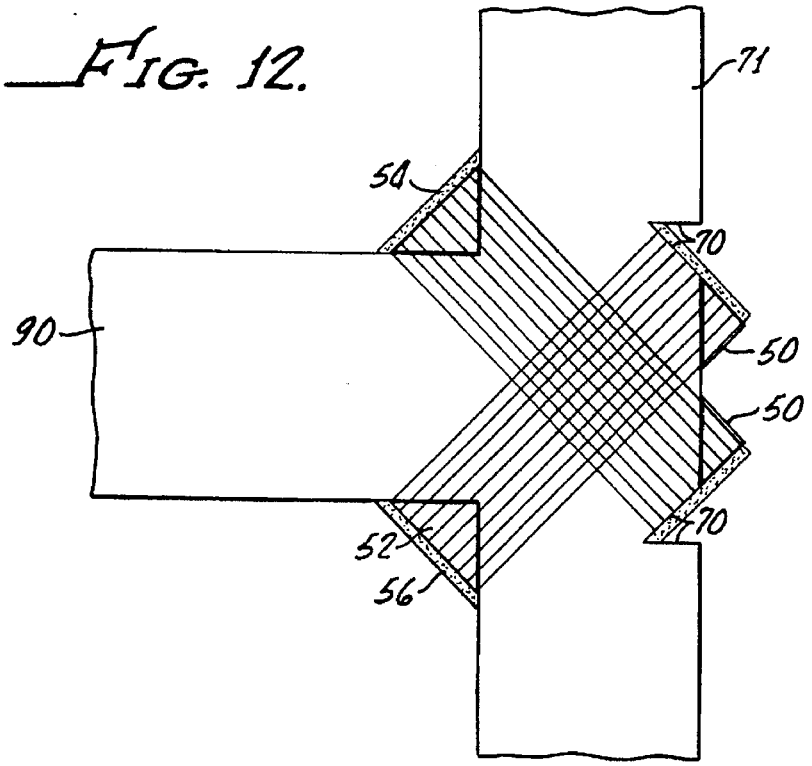
FIG. 12 is a side elevation view of a third preferred embodiment of the present invention.

FIG. 12 shows a third preferred embodiment of the present invention. Notches 70 are provided in column 71. Fabric wraps 54 and 56 having predominantly unidirectional fibers wrap around column 71, structural cross member 90, and wrap supports 50 and 52 having triangular cross section, to reinforce the connection between column 71 and cross member 90. The unidirectional fibers of wraps 54 .and 56 are oriented at ±45° relative to the axis of column 71. Wrap supports 50 and 52 are preferably affixed to the structural members 71 and 90 using an adhesive before wraps 54 and 56 are applied. Wraps 54 and 56 preferably each comprise a continuous sheet of fabric wrapped around column 71 and cross member 90 multiple times. Where column 71 and cross member 90 are concrete and are cast integral in new construction, support blocks 52 may be cast as part of the column and cross member combination.

Figure 13:
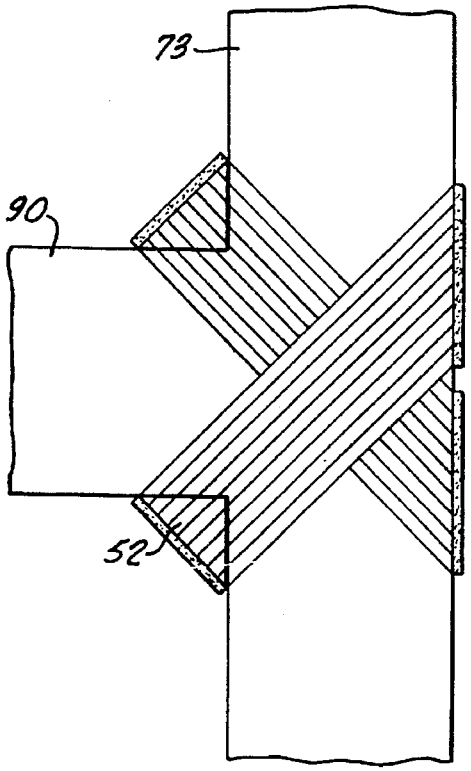
FIG. 13 is a side elevation view of an alternative third preferred embodiment of the present invention.
Figure 13A:
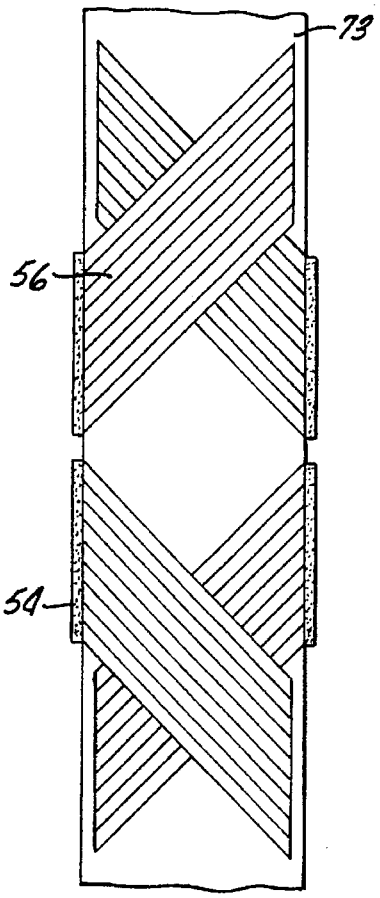
FIG. 13A is a side elevation view of the structure shown in FIG. 8, taken from a different angle.

An alternative third preferred embodiment is shown in FIG. 13. The notches 70 and support blocks 50 of FIG. 12 are eliminated. Wraps 54 and 56 wrap directly around column 73, as revealed more fully in FIG. 13A. Additional wraps may be added to provide further anchorage for wraps 54 and 56.

In all of the embodiments of the present invention, the reinforcing composite may be adhered to the structural member through the adhesive properties of the polymer matrix itself, an additional adhesive, fiber fasteners, or other anchoring means as discussed above.

All of the embodiments described above may be modified if desired for retrofit and repair of already damaged structures. The damaged structures is examined to determine the actual fracture pattern present, and the cloth type, weave, fiber direction, and bias angle of cut are modified to provide maximum strength perpendicular to the predominant fracture axis or axes.

Figure 14:
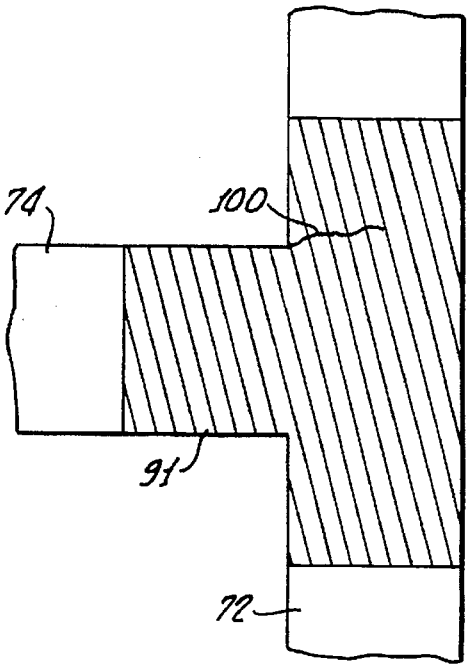
FIG. 14 is a side elevation view of a reinforced structural connection, illustrating how the present invention may be modified to provide maximum reinforcement for an already damaged structural connection.

In FIG. 14, for example, fabric 91 is selected and cut on the bias so as to provide maximum strength perpendicular to fracture 100. Depending on the existing fracture pattern and the axis or axes in greatest need of reinforcement, the fabric chosen may Contain unidirectional fibers, fibers interwoven at a 90° angle, or fibers interwoven at any desired angle. Additional tie wrap layers may be added as described above, for additional anchorage.

The composite material should be fire resistant. Commercially available coatings such as FIREGUARD may be used. Alternatively, the resin in the composite reinforcement layer may be impregnated with an intumescent or a low temperature melting glass suitable for rendering the composite reinforcement layer fire resistant. The melting glass preferably has a melting temperature of no more than about 800 degrees Fahrenheit. Where an intumescent is used, it is preferred that an intumescent powder or liquid be added to both a thickened outer layer of epoxy and a coating paint. PYROPLUS™ powder and PYROPLUS™ ITM liquid, both available from Fire & Thermal Protection Engineers, Inc., Petersburg, Ind., have been found to be suitable. The coating paint may be chosen to match the surrounding or historic concrete, to give a smooth or textured appearance, or to meet other aesthetic purposes as the architect directs.

A wide variety of composite materials may be used. While fabric impregnated with epoxy resin to reinforce a concrete elevated roadway structure has been illustrated, those skilled in the art will appreciate that the present invention may be used with a wide variety of fibers and polymer matrices to reinforce a similarly wide variety of structures.

The fabric, for example, may be comprised of glass, graphite, polyaramid, boron, KEVLAR™ (polyaramid), silica, quartz, ceramic, polyethylene, aramid, or other fibers. A wide variety of types of weaves and fiber orientations may be used in the fabric. The polymer matrix with which the fabric is impregnated may be comprised of polyester, epoxy, vinyl ester, cyanate, polyamide, or other polymer matrices, with epoxy being preferred for most applications. Preferably, the fiber and polymer matrix are waterproof and ultraviolet fight (UV) resistant.

Similarly, the structure to be reinforced need not be a roadway platform supported by a beam that is in turn supported by a vertical column. For example, the present invention could also be applied to a structure in which the beams support joists rather than a roadway, or in which columns support a platform directly without the use of beams. The present invention could also be used where the supporting columns are round. The present invention could further be used where the connections to be reinforced are: "cross" rather than "T" connections; horizontal rather than vertical; or at an angle other than 90°, as is common in bridge support latticework.

Accordingly, while several embodiments have been shown to illustrate the invention, it will be understood by those skilled in the art that various changes and modifications can be made therein without departing from the scope of the invention as defined in the appended claims and their appropriately construed legal equivalents.

What is claimed is:

1. A reinforced structure wherein a platform is supported by beams and wherein said beams are in turn supported by columns, said reinforced structure comprising:

a structural platform having a lower surface;

at least one beam extending laterally under said structural platform, said beam having a top portion which is connected to said lower surface of said structural platform to provide support thereof, said beam also having two side surfaces and a bottom surface;

a support column having a top portion connected to the bottom surface of said beam, said support column also having one or more sides defining a column extending away from said beam;

composite material beam reinforcement means for reinforcing the connection of said structural platform to said beam; and at least one fabric strip for securing said reinforcement means to said structure, said fabric strip being adhered in part to a surface of said reinforcement means and extending into a cavity formed within said structure and secured therein.

2. A reinforced structure according to claim 1 wherein said composite beam material reinforcement means includes fire resistant means.

3. A reinforced structure according to claim 1 wherein said fire resistant means is selected from the group consisting of an intumescent and a low temperature melting glass.

4. A reinforced structure wherein a platform is supported by beams and wherein said beams are in turn supported by columns, said reinforced structure comprising:

a structural platform having a lower surface;

at least one beam extending laterally under said structural platform, said beam having a top portion which is connected to said lower surface of said structural platform to provide support thereof, said beam also having two side surfaces and a bottom surface;

a support column having a top portion connected to the bottom surface of said beam, said support column also having one or more sides defining a column extending away from said beam; and a composite material shell for reinforcing the connection of said structural platform to said beam, said shell comprising:

a beam encasement portion which covers the bottom surface and two side surfaces of said beam;

a structural platform portion which is integral with said beam encasement portion and which extends from said beam encasement portion so as to cover at least a portion of the lower surface of said structural platform;

means for securing said beam encasement portion to said beam; and means for securing said structural platform portion to said structural platform.

5. A reinforced structure according to claim 4 wherein said composite material shell comprises fibers in a polymer matrix.

6. A reinforced structure according to claim 5 wherein said fibers are selected from the group consisting of glass, carbon, boron, polyaramid, silica, quartz, ceramic, aramid, polyaramid, and polyethylene.

7. A reinforced structure according to claim 6 wherein said polymer matrix is selected from the group consisting of polyester, epoxy, vinyl ester, cyanate, and polyamide.

8. A reinforced structure according to claim 7 wherein said beam and said support column are comprised of steel reinforced concrete.

9. A reinforced structure according to claim 8 wherein said means for securing said beam encasement portion to said beam comprises fasteners which connect the beam encasement portion to the side surfaces of said beam.

10. A reinforced structure according to claim 9 wherein said means for securing said structural platform portion to said structural platform comprises fasteners which connect the structural platform portion to the lower surface of said structural platform.

11. A reinforced structure wherein a platform is supported by beams and wherein said beams are in turn supported by columns, said reinforced structure comprising:

a structural platform having a lower surface;

at least one beam comprised of steel reinforced concrete, said beam extending laterally under said structural platform, said beam having a top surface which contacts said lower surface of said structural platform to provide support thereof, said beam also having two side surfaces and a bottom surface;

a support column comprised of steel reinforced concrete, said support column having a top surface in contact with the bottom surface of said beam, said support column also having one or more sides defining a column extending away from said beam; and a composite material wrapping for reinforcing the connection of said support column to said beam, said composite material wrapping comprising:

composite material connection wrappings which cover the two side surfaces of said beam in the area where said beam is connected to said support column, said composite material connection wrappings also extending onto the side surfaces of said support column;

first and second beam tie wrappings which each comprise a composite material, said first and second tie wrappings being wrapped around said composite material connection wrappings located on said beam on either side of the location where said beam connects to said support column; and a column tie wrapping which comprises a composite material which is wrapped around said composite material connection wrapping located on said support column.

12. A reinforced structure according to claim 11 wherein said composite material column reinforcement means further comprises:

a fire resistant substance selected from the group consisting of an intumescent and a low temperature melting glass.

13. A reinforced structure according to claim 11 wherein said beam has a longitudinal axis and said support column has a longitudinal axis, and wherein said composite material connection wrappings are comprised of fibers in a polymer matrix.

14. A reinforced structure according to claim 13 wherein said fibers are oriented at an angle of substantially plus and minus 45° with respect to the longitudinal axes of said beam and said support column.

15. A reinforced structure according to claim 13 wherein said fibers are oriented along the longitudinal axis of said beam.

16. A reinforced structure according to claim 13 wherein said fibers are oriented perpendicular to the axis of said beam.

17. A reinforced structure according to claim 13 wherein said first and second tie beam wrappings and said column tie wrapping comprise fabric containing substantially unidirectional fibers.

18. A reinforced structure according to claim 17 wherein said fibers in said composite material connection wrappings, said first and second beam tie wrappings and said column tie wrapping are selected from the group consisting of glass, carbon, boron, polyaramid, silica, quartz, ceramic, aramid, polyaramid, and polyethylene.

19. A reinforced structure according to claim 18 wherein said polymer matrix for said composite material connection wrappings is selected from the group consisting of polyester, epoxy, vinyl ester, cyanate, and polyamide.

20. A reinforced structure for supporting an elevated roadway comprising:

a support column having a longitudinal axis;

a structural cross member connected to said support column, said structural cross member having a longitudinal axis; and composite material column reinforcement means for reinforcing the connection of said support column to said structural cross member, said composite column reinforcement means comprising:

composite material connection wrapping which covers at least a portion of the connection between said support column and said structural cross member, and further covers at least a portion of said support column and at least a portion of said cross member:

a first tie wrapping which comprises substantially unidirectional fibers in a polymer matrix, said first tie wrapping being wrapped around said composite material connection wrapping located on said support column; and a second tie wrapping which comprises substantially unidirectional fibers in a polymer matrix, said second tie wrapping being wrapped around said composite material connection wrapping located on said structural cross member.

21. A reinforced structure for supporting an elevated roadway comprising:

a support column;

a cross member connected perpendicular to said support column at a first end of said cross member, said cross member having an upper and a lower surface, said cross member having a longitudinal axis;

a first wrap support comprising an elongate member of isosceles triangular cross section, said first wrap support abutting both said support column and the upper surface of said cross member;

a second wrap support comprising an elongate member of isosceles triangular cross section, said second wrap support abutting both said support column and the lower surface of said cross member;

composite reinforcement means for reinforcing the connection between said support column and said cross member, said composite reinforcement means comprising:

a first wrapping, said first wrapping being wrapped over said first wrap support and extending onto said support column at an angle of plus 45° with respect to the longitudinal axis of said cross member;

a second wrapping, said second wrapping being wrapped over said second wrap support and extending onto said support column at an angle of minus 45° with respect to the longitudinal axis of to said cross member.

22. The reinforced structure of claim 21 wherein:

said composite reinforcement means further comprises a fire resistant substance selected from the group consisting of an intumescent and a low temperature melting glass.

23. The reinforced structure of claim 21 wherein:

said first and second wrappings comprise substantially unidirectional fibers in a polymer matrix.

* * * * *